US005267711A

United States Patent [19]

Perreault

[11] Patent Number: 5,267,711

[45] Date of Patent: Dec. 7, 1993

[54] BAG HOLDER DEVICE

[76] Inventor: Thomas Perreault, 73 Anthony Rd., Dalton, Mass. 01226

[21] Appl. No.: 916,694

[22] Filed: Jul. 20, 1992

[51] Int. Cl.[5] ..... B65B 67/04

[52] U.S. Cl. ..... 248/101; 141/341

[58] Field of Search ..... 248/95, 97, 98, 99, 248/100, 101; 220/404; 141/341

[56] References Cited

U.S. PATENT DOCUMENTS

| | | | |
|---|---|---|---|
| 3,707,271 | 12/1972 | Sanchez et al. | 248/101 |
| 4,469,227 | 9/1984 | Faust | 248/95 X |
| 4,759,518 | 7/1988 | Yardas | 248/97 |
| 4,819,898 | 4/1989 | Benoit et al. | 248/97 |
| 4,934,636 | 6/1990 | Orlosky et al. | 248/95 |

*Primary Examiner*—Ramon O. Ramirez
*Attorney, Agent, or Firm*—Kent I. Patashnick

[57] ABSTRACT

A bag holder device is disclosed then comprises first and second component members interconnectable to form a composite beam member. Each component member has a respective end portion so that when the component members are interconnected, the end portions are oppositely disposed. Each end portion has a support surface that is delimited by a border over which a portion of a bag's wall overhangs when draped onto the support surface. Respective to each end portion is housing that fits thereover to clamp the overhanging bag portion about the border and to clamp the portion of the bag draped on the support surface about the border. Each housing is pivotally attached about its respective end portion in order to rotate on and off the respective end portion. The composite beam has a surface mounting portion integral to each component member which fits against a mounting surface and planarly offsets the end portions away from the mounting surface so that a portion of a bag's wall can be fully draped about each end portion.

20 Claims, 7 Drawing Sheets

BAG HOLDER DEVICE

FIELD OF THE INVENTION

The present invention pertains to bag holder devices for holding bags More specifically, the present invention relates to a bag holder device that spreads open a bag's opened end, supports and secures a bag, and mounts to a surface.

BACKGROUND OF THE INVENTION

Problems encountered with bag holder devices are multifold. If a bag is suspended by its walls, it can tear, rip, stretch, sag, or slip from the device, especially as the bag becomes fuller and heavier. Such complications are particularly notable with relatively thin and smooth walled bags.

Another difficulty occurs upon removing a bag from a support device. A bag can fall or topple upon being detached, or it may have to be hoisted in order to disengage it from said device. Not only can such lifting be inconvenient, but the bag can tear or rip when lifted by its walls. It would be preferable if a bag could be detached from a support device in a way where a person could grab hold of the bag before it fell, as well as allowed a person to remove it without having to lift the bag.

Another complication with support devices involves spreading a bag's opened end so that it can be used. Since bags come with differently sized mouth openings, it is necessary to dimension adequately the bag's opening in order to spread its opened end, and to account for different bag opening widths.

OBJECTIVES OF THE INVENTION

Accordingly, it is an objective of the present invention to provide a bag holder device that firmly supports, secures and suspends, operably and usably, a bag, while minimizing any tearing, ripping, or slipping of the bag.

Another objective of this invention is to provide a bag holder device that spreads sufficiently and adequately the opening mouth of a bag's opened end, as well as accommodate differently sized bag opening widths.

Still, another objective of this invention is to provide a bag holder device that allows a person to place a bag thereon quickly, easily and securely, while and quickly, without tearing or lifting the bag.

Still, another objective of this invention is to provide a bag holder device that mounts to a wall or support structure.

Still, another objective of this invention is to provide a bag holder device that suspends a bag by supporting and securing different wall portions of a bag's opened end.

These and still further objectives will become apparent hereinafter.

SUMMARY OF THE INVENTION

The foregoing objectives are realized by providing a mountable bag holder device that spreads and supports different wall portions of a bag's opened end between oppositely disposed bag holder end portions, and clamps said wall portions tightly thereon. The bag holder device comprises oppositely disposed and axially adjustable end portions that each comprises a support surface that has lateral edges and an end edge, and means respective to each end portion for clamping a portion of a bag's wall draped over each end portion's support surface thereabout, and a mounting portion that planarly offsets the support surfaces from a support structure when mounted thereto so that said bag's wall portions can be draped fully over the end portion.

The support surface is broad in order to distribute better a bag's weight, and provide support and prop for a bag, with its surface area delimited by its three edges. The end portion further comprises lateral side faces and an end face respective to each of said edges. At least one of said edges is convexly curved toward its corresponding face, preferably the end edge in order to facilitate removal of a bag from the bag holder device (by simply sliding the bag's wall portion off the support), and minimizing tearing of a bag's wall when extended between the end portions. Each support's respective clamping means is pivotally attached so that it can be rotated onto the end portion or off therefrom.

The clamping means comprises a housing member that can fit tightly over its respective end portion. Each housing has an interior portion with inner lateral surfaces, an inner end surface, and a mouth for receiving the respective end portion. The inner surfaces correspond respectively to the support surfaces' edges and faces. In the preferred embodiment, the housing's interior dimensions are approximately reciprocal to the end portion dimensions. Or, the length and width dimensions of the housing's interior approximately match the length and width dimensions of the support surface, and the depth dimension of the housing approximately matches the thickness of the end portion as defined by the heights of the end portions faces, so that the housing can fit tightly over the end portion when placed thereover. In this manner, upon draping a part of a bag's opened end about an end portion and fitting the respective housing thereover, the housing clamps those portions of the bag's opened end wall hanging over the support's edges about the respective end portion. The housing is generally flexible to ensure a tight fit and sufficient give in order to fit over the respective end portion.

There are many advantages to the present invention. The opposite end portions enable spreading a bag's opened end so that its mouth is opened. Also, by being axially adjustable, the bag holder can accommodate different bag mouth sizes. Also, the broad surface area of the support surface better distributes a bag's weight to reduce the sagging or stretching seen with devices that suspend a bag along a continuous and contiguous wall. Also, since different bag wall portions are held by separate supports, a person has opportunity to grab hold of the bag prior to it toppling when removed from the holder device. Also, the bag holder device can be mounted to a support structure (i.e. to a wall) for positioning at different heights in order to accommodate different bag lengths, as well as permitting convenient positioning. Moreover, the convexly curved edge minimizes tearing or ripping a bag's wall, as well as allowing the bag's wall to slide off when being removed from the supports. And, the present invention facilitates bag installation by allowing simple draping of a bag's wall portion onto the holder's end portions, and then clamping it thereto.

Other advantages also include the bag holder device's beam design. In the preferred embodiment, this design allows easier engineering of a mechanism for adjustable positioning of the end portions. Since the entire device is crafted around a longitudinal axis, the end portion's can be separable and constructed to interconnect easily.

Notwithstanding the above advantages, the housing and end portion combination enables a very tight and firm hold because of the multiple edge-face design of each end portion and the reciprocal inner edge-face design of each housing. Essentially, the present invention presents multiple surfaces for clamping purposes, as well a support prop to counter gravitational pull on a bag draped thereover. Consequently, the present invention minimizes any slipping and sliding of a bag draped thereon off of the bag holder's end portions

DETAILED DESCRIPTION OF THE INVENTION

Figure 1:
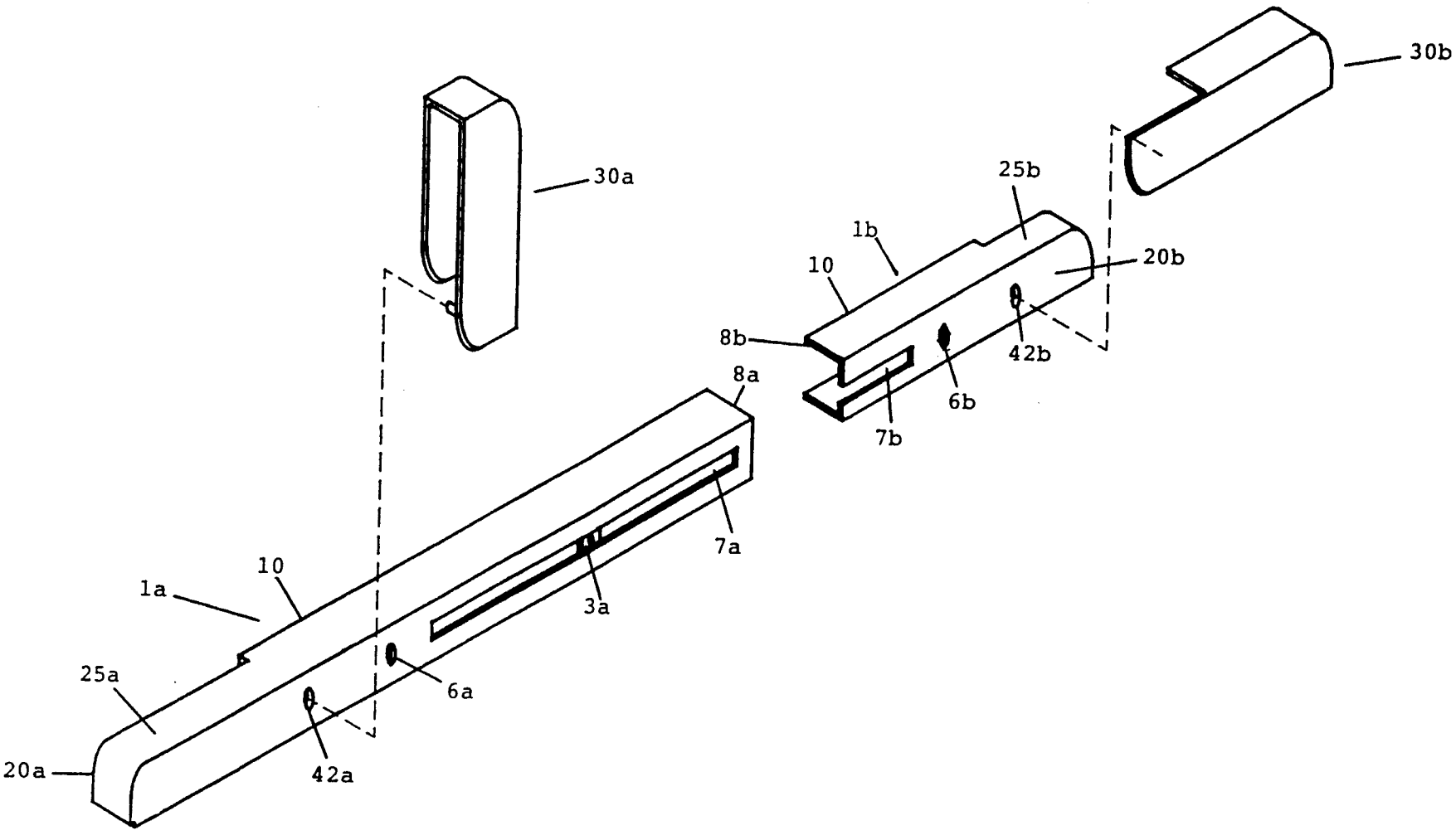
FIG. 1 is a perspective view of one embodiment of the holder device depicting the separate component beam members of the composite beam.

An in depth description of the invention and the preferred embodiment is now in order. With reference to the drawings, like reference characters designate like or corresponding parts throughout the several views.

Figure 2:
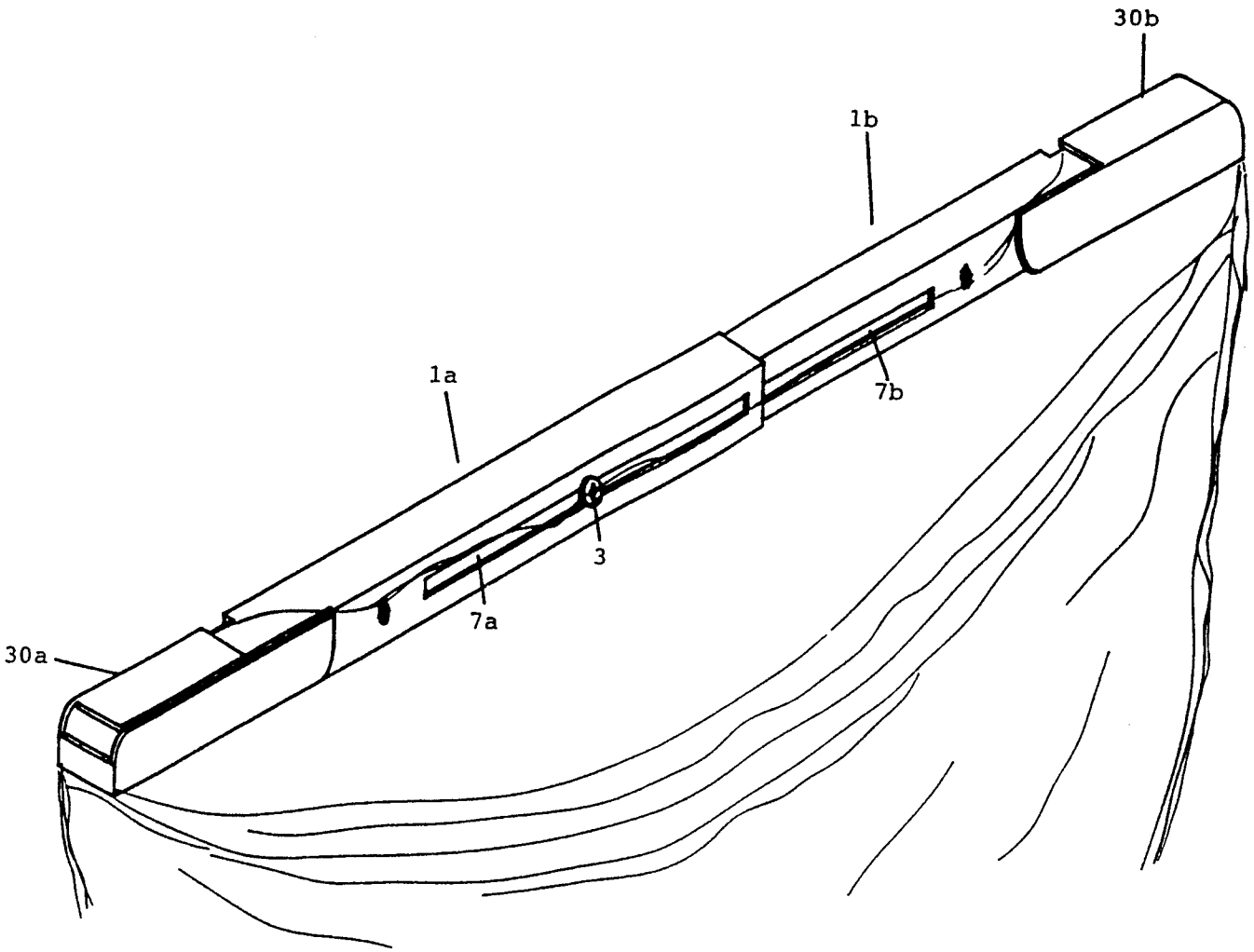
FIG. 2 is a perspective view of one embodiment of the holder device, wherein each housing is shown in a clamped position.
Figure 6:
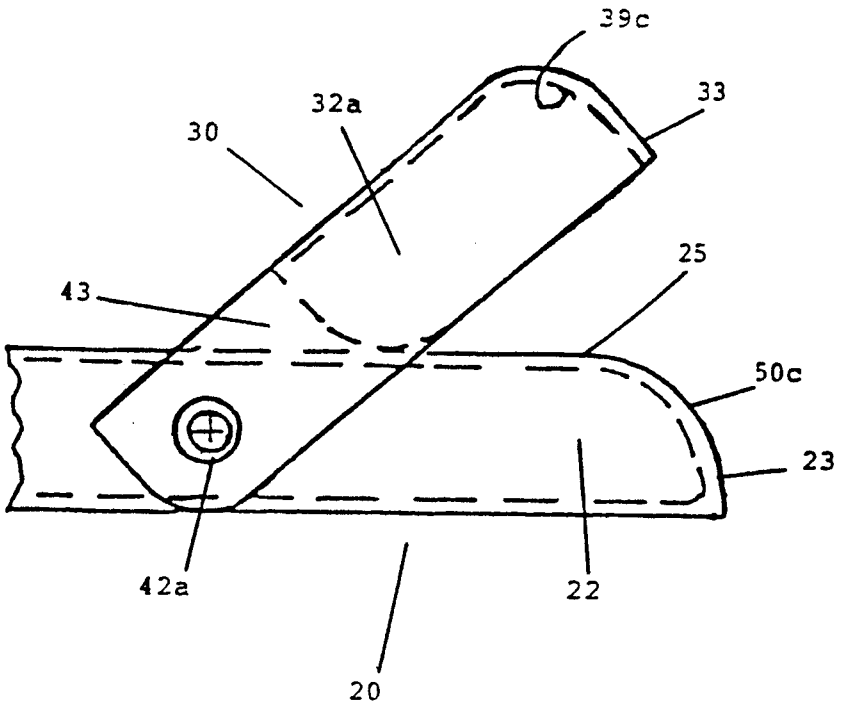
FIG. 6 is a two-dimensional side view of an end portion with its respective housing member rotated to an unclamped position.

Referring to FIG. 1 and FIG. 2, beam 1 has mounting portion 10, and oppositely disposed end portions 20*a* and 20*b* with respective housing members 30*a* and 30*b*. End portions 20*a* and 20*b* have support surfaces 25*a* and 25*b* respectively. As best shown in FIG. 6, housing 30*a* can rotate between a clamped and unclamped position about end portion 20*a*.

Figure 4:
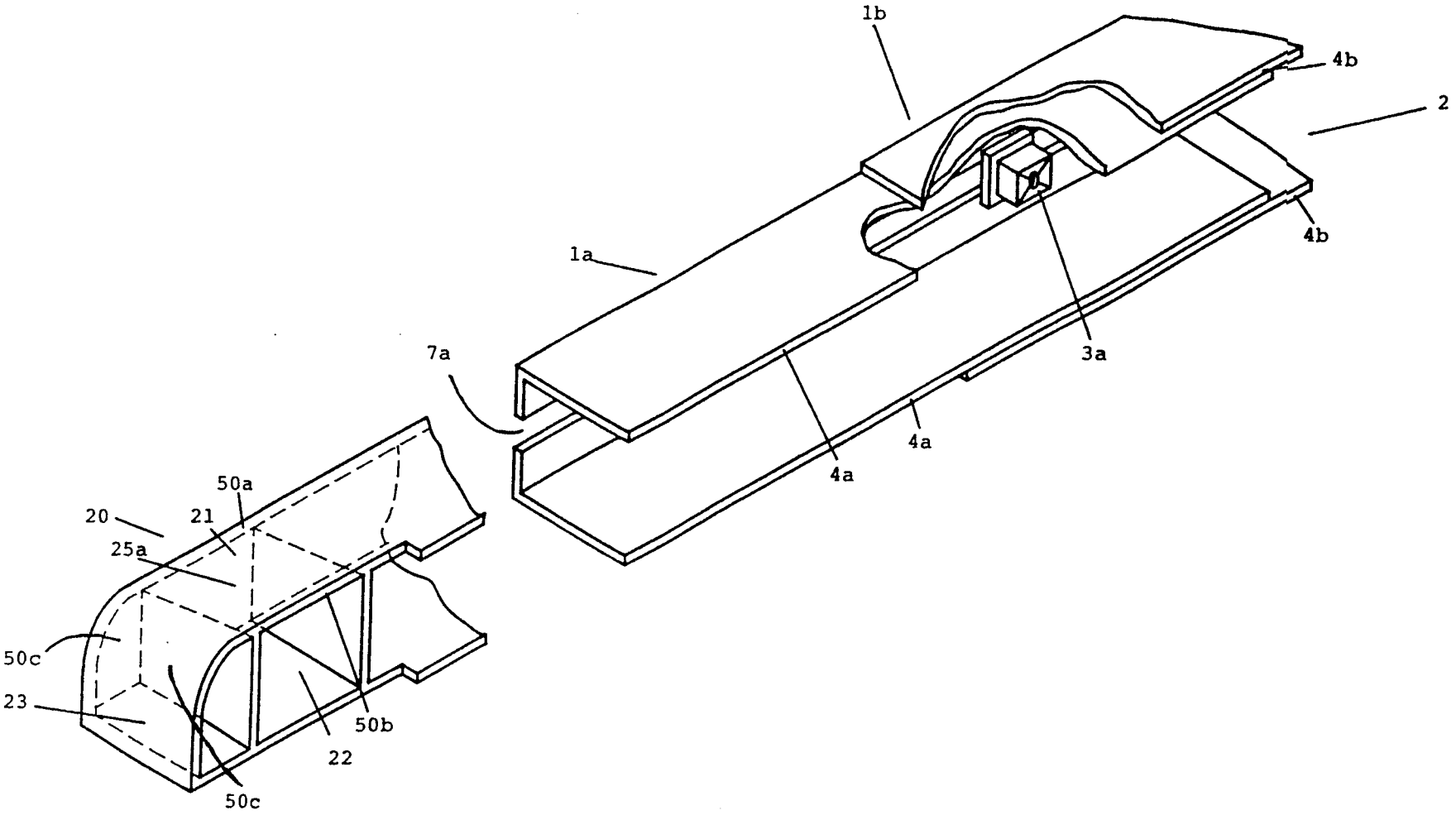
FIG. 4 is a sectionalized and partial view of one embodiment of each component member; also shown is an embodiment of an end portion.

In this particular embodiment, which is considered the best mode, beam 1 comprises a composite beam of two separate component members 1*a* and 1*b*. As best shown in FIG. 4, each component member is constructed as a generally open space U-shaped partial beam, wherein the open U-shaped space forms a channel that runs from each component members' insert end 8*a* and 8*b* respectively until approximately each component members' end portions 20*a* and 20*b* respectively. Component member's 1*b* channel is adapted to receive component member 1*a* slidably therein. And as shown in FIG. 1 and FIG. 4, the composite beam is assembled by installing insert end 8*a* of component 1*a*into channel 2 of channel insert end 8*b* of component 1*b*. Slots 7*a* and 7*b* of component members 1*a* and 1*b* respectively are axially aligned when component members 1*a* and 1*b* are interconnected via channel 2, so that slot screw 3 can be inserted through slots 7*a* and 7*b*, wherein screw nut 3*a* can be tightened about screw's 3 shaft portion. Slot screw 3, in combination with screw nut 3*a*, fastens component members 1*a* and 1*b* together, and also locks component members 1*a* and 1*b* at a particular axial position relative to each other.

End portions 20*a* and 20*b* can be axially adjusted in order to accommodate different sizes of bag mouths by loosening screw nut 3*a*, and axially sliding component members 1*a* and 1*b* relative to each other to a desired overall axial length. Component members 1*a* and 1*b* are then fixed at their desired relative positions by tightening nut 3*a* about screw 3.

Beam 1 mounts and secures to a support structure (i.e. a wall) [not shown] by fitting mounting faces 4*a* and 4*b* of mounting portion 10 against (and at the desired height and location thereon) a support structure, and then inserting screws [not shown] through screw holes 6*a* and 6*b*, and then screwing the screws into a support structure. Upon fitting mounting faces 4*a* and 4*b* against a support structure and fastening beam 1 to a support structure, support surface 25*a* and 25*b* of end portions 20*a* and 20*b* respectively are approximately in an upright position. In this embodiment, mounting faces 4*a* and 4*b* are flat in order to sit flush against a support structure.

Upon mounting beam 1 to a support structure, because mounting portion 10 is planarly offset from end portions 20*a* and 20*b*, the lateral faces 22 of each end portion, as shown in FIG. 4, will not fit against the particular support surface, but instead, lateral faces 22 will be offset therefrom. Mounting portion 10 offsets end portions 20*a* and 20*b* when mounting faces 4*a* and 4*b* are placed and positioned against a support structure. This offset of lateral faces 22 permits a bag's wall to be draped over support surfaces 25*a* and 25*b* when beam 1 is mounted to a support structure. In this way, the bag's wall can be draped over support surface 25 and portions thereof extended over faces 21, 22 and 23.

Figure 5:
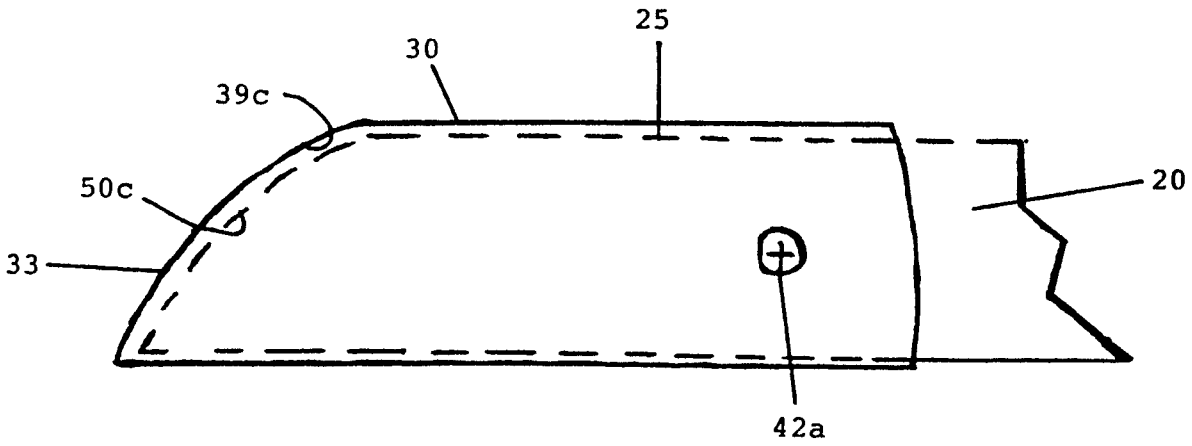
FIG. 5 is two-dimensional side view of a portion of one embodiment of an end portion with its respective housing member clamped thereover, wherein the end portion is shown by the dotted lines.

Referring now to FIG. 4, FIG. 5 and FIG. 6, a detailed depiction of a support surface 25 is shown. Support surface 25 and detail discussed herein are representative of support surfaces 25*a* and 25*b*. Lateral edge portions 50*a* and 50*b* in combination with end edge portion 50*c* delimit support surface 25. Support surface 25 is broad surfaced and flat in order to distribute better and support a bag's weight when a portion of a bag's wall is draped thereabout, and to minimize any tearing, ripping or stretching of said bag portion. It should be noted that flatness is not necessarily required to practice the invention. Lateral edge portions 50*a* and 50*b* extend approximately perpendicularly downwards into opposite lateral faces 21 and 22. Whereas, end edge portion 50*c* convexly curves into end face 23. It should be observed that any or all of aforementioned edge portions can be convexly rounded, and curve into their respective face.

Figure 3:
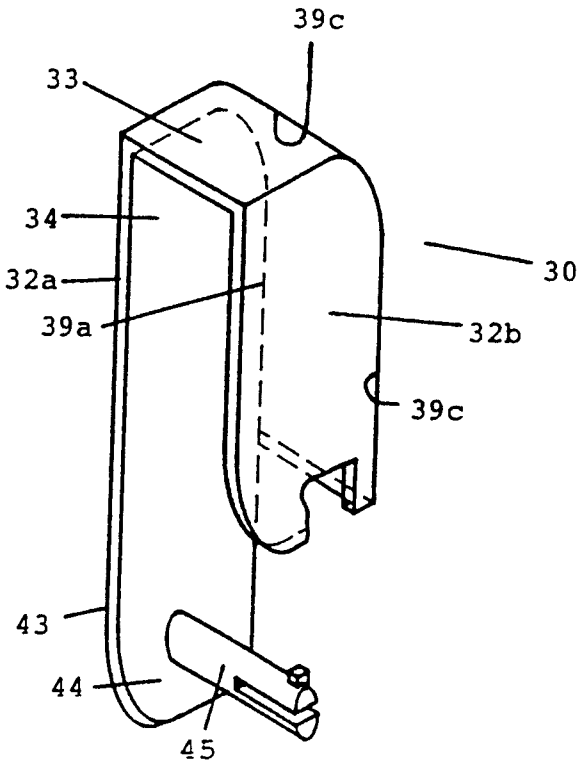
FIG. 3 is a view of one embodiment of the clamping means.
Figure 7:
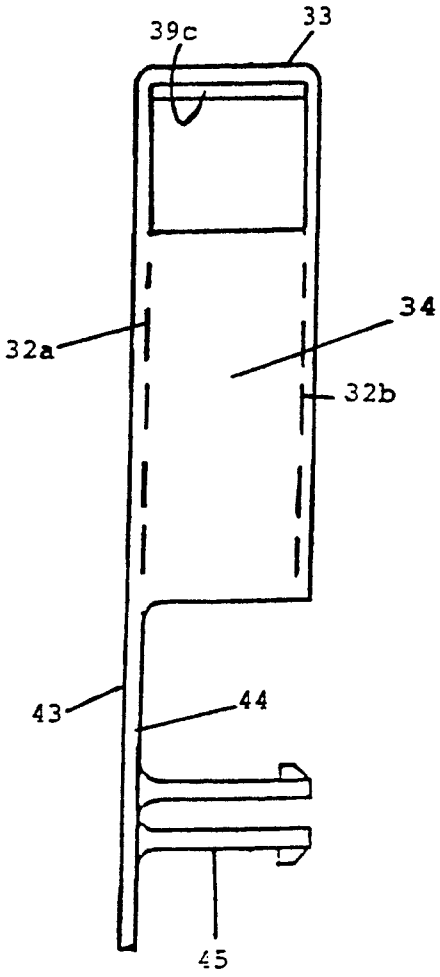
FIG. 7 is a view of a housing member looking down onto its inner surfaces, wherein the dotted lines represent the inner lateral edges of the housing member.

Referring now to FIG. 3 and FIG. 7, a detailed depiction of housing member 30 is shown. Housing 30 and detail discussed herein are representative of housings 30*a* and 30*b*. Housing 30 comprises roof part 31, lateral side parts 32*a* and 32*b*, and end part 33. Each part has respective inner surfaces that delimit housing's 30 inner dimensions, wherein parts 32*a*, 32*b* and 33 form inner edges 39*a*, 39*b* and 39*c* at their respective intersections with roof 31. Housing mouth 34 has an opened dimensional area slightly greater than the area of support surface 25 in order to receive support surface 25 therein when housing 30 is rotated thereover.

Housing's 30 inner dimensions are approximately reciprocal (though slightly greater) to the dimensions of end portion 20, as delimited by end portion's faces and edges, so that housing 30 can fit tightly and snugly over and fully encase end portion 20. When housing 30 is fitted over end portion 20, housing's 30 corresponding inner surfaces and edges engage end portion's 20 respective faces and edges in order to tightly clamp a bag wall portions draped thereover. It is preferred that housing 30 be semi-rigid or flexible in order to flex when forced over end portion 20.

Segment 43 extends away from end portion 20 further than face 32*a* in order to provide an area for attachment and pivoting to the respective component beam member. Segment 43 has inner surface 44, with split pin 45 extending approximately perpendicularly therefrom. Pivot hole 42 extends through a portion of beam 1 (respective to each end portion) at a location adequate to allow housing 30 to swing onto end portion 20 to encase it fully, and to swing thereoff. Hole 42 has a diameter adapted to receive split pin 45 tightly therein. Split pin 45 serves as a pivot axis for housing 30, as well as a means for fastening housing 30 to beam 1.

Referring to FIG. 2, FIG. 5 and FIG. 6, a bag is suspended from beam 1 by pivoting housing 30*a* off of end portion 20*a*, and then draping one portion of a bag's wall over a support surface 25*a* of end portion 20*a* so that a portion of said bag's wall extends over lateral faces 21 and 22 and end face 23. Housing 30*a* is then pivoted to fit over end portion 20*a*.

When housing 30*a* is completely fitted over end portion 20*a*, the bag portion lying over support surface 25*a* is spread tightly thereabout, and the portions extending over edges 50*a*, 50*b* and 50*c* onto faces 21, 22 and 23 are tightly gripped between housing's inner surfaces 36*a*, 36*b* and 38 respectively. Additionally, housing's 30*a* inner edges 39*a*, 39*b*, and 39*c* engage bag portions about edges 50*a*, 50*b* and 50*c* thereagainst—and clamp said portions thereabout. A different wall of said bag is then draped and clamped about the other end portion 20*b* in a manner likewise to that just described. The order in which a bag is draped about the end portions or clamped is not important.

To remove a bag from beam 1, the housing 30 are pivoted off of end portion 20. The portions of said bag's wall draped over the respective end portion 20 are then slid off by sliding said bag wall portions over support surface 25 directionally toward convexly curved end edge 50*c*. Again, the order in which said housings are opened or the bag wall portions are slid off is not important.

All of the different parts of the bag holder device herein disclosed and described can be molded from plastic. However, one is not limited to plastic in order to practice the invention.

It is understood to one skilled in the art that the bag holder device herein disclosed and described can be mounted and fastened to a support structure in any number of ways. For example, the mounting face portion can be glued to a support structure, or nailed thereto. Further, it understood to one skilled in the art that each end portion herein disclosed and described can have a bottom surface, wherein said end portion faces would extend between said support surface and said bottom surface. In such an embodiment, the housing member could be adapted to clip releasably to the bottom surface, and at the same time clamp a portion of a bag draped over the end portion thereto.

While the preferred embodiment of the invention has been disclosed and described, further modifications of the invention herein disclosed will occur to those skilled in the respective art and all such modifications are deemed to be within the scope of the invention as defined by the appended claims.

What is claimed is:

1. A bag holder device that comprises:

a. a beam member having oppositely disposed end portions, wherein each end portion comprises a support surface, said support surface having a width delimited by at least a first edge and a second edge, and a length restricted by an end edge, so that when a portion of a bag is draped over said support surface, the bag portion can extend and hang over said edges;

b. means respective to each end portion for clamping a portion of a bag's wall thereabout, comprising a housing that removably fits over a respective end portion, i. wherein said housing has an interior delimited by an inner surface, and a mouth connecting with said interior; and, ii. wherein said interior is at least reciprocally dimensioned to said end portion so that, when said housing is fitted over said housing's respective end portion, said housing can fit tightly over said end portion, wherein portions of said housing's inner surface reciprocal to said support surface edges engage said support surface edges in order to clamp at least portion of a bag's wall draped thereover and secure any portion a bag's wall lying on said support surface thereto;

c. a mounting portion integral with said beam, wherein said mounting portion has at least one mounting face for fitting against a structural support which is planarly offset from said end portions so that when said beam member is mounted to a structural support, said end portion is offset from that portion of the structure support opposing the end portion corresponding therewith in order to allow a bag's wall to be draped over said support surface and extended over said support surfaces' edge; and, d. means for fastening said beam member to a structural support, wherein said fastening means enables the fastening of said beam to a structural support so that said mounting face portion lies firmly thereagainst.

2. A bag holder device as claimed in claim 1, wherein each end portion further comprises opposite lateral side faces, and an end face, so that a portion of a bag that is draped over said end portion can hang about each end portion's face; and, wherein, when said housing respective to an end portion is placed thereover, portions of said housing's inner surface fit tightly about each face of said end portion in order to grip a portion of a bag wall hanging over each face tightly thereabout.

3. A bag holder device as claimed in claim 2, wherein at least one of said support surface edges of each end portion is convexly curved toward said edge's respective face.

4. A bag holder device as claimed in claim 3, wherein each housing is pivotally attached to a portion of said beam respective to each housing's respective end portion so that said housing can rotate between a clamped position and an unclamped position, wherein when said housing is in the clamped position, said housing fits snugly over said housing's respective end portion, and wherein, when said housing is in the unclamped position, said housing releases from said end portion.

5. A bag holder device as claimed in claim 4, wherein each housing has a roof portion, said roof portion having an inner surface portion that clamps against at least one edge of a support surface respective to said housing when said housing is rotated to the clamped position.

6. A bag holder device as claimed in claim 5, wherein said beam member comprises two component members that interconnect to form a composite beam member, each component member having an end portion so that when said component members are interconnected, said end portions are oppositely disposed from each other, and wherein means for interconnecting allows said component members to be joined so that at least one of said component members can be moved relative to said other component member, said means for interconnecting comprising:

a. a channel extending along a portion of at least one of said component members with which said other component member slidably connects so that at least one of said component members can be slid relative to said other component member; and, b. means for securing at least one of said component member to said other component member in order to secure said component members at a particular position relative to each other.

7. A bag holder device as claimed in claim 6, wherein said means for interconnecting further comprises a slot extending along a portion of each of said component members through which a screw can be inserted, said slots being aligned when said component members are interconnected so that said screw can be inserted through said slots; and, wherein said securing means is a nut that fastens to said screw, thereby securing said component members tightly together, wherein said component members can be slid relative to each other and then secured in position by tightening said nut onto said screw.

8. A bag holder device as claimed in claim 7, wherein said fastening means comprises a plurality of spaced holes passing through said beam member, and screws insertable therethrough for screwing said beam member to a structural support.

9. A bag holder device as claimed in claim 8, wherein at least one of said edges of each support surface overhangs said edge's respective face, wherein each housing has a groove extending across the portion of said inner surface corresponding to that overhanging edge, said groove being aligned and adapted to receive releasably said edge overhang therein when said housing is rotated to the clamped position.

10. A bag holder device as claimed in claim 8, a. wherein each end portion further comprises a bottom surface, wherein said faces extend between said support surface and said bottom surface; and, b. wherein said housing has a catch that releasably engages said bottom surface.

11. A bag holder device that comprises:

a. a frame that comprises oppositely disposed end portions, wherein each end portion comprises a support surface delimited by a border over which a portion of a bag draped about said support surface can hang over; and, b. means respective to each end portion for clamping a bag's wall thereover, that comprises a housing for removably fitting over a respective end portion that has an interior delimited by an inner surface, wherein said housing is large enough to fit over said respective end portion's support surface, so that said housing can fit tightly over said housing's respective end portion in order to clamp a portion of a bag's wall draped over said end portion tightly thereon.

12. A bag holder device as claimed in claim 11, wherein said bag holder device further comprises:

a. a mounting portion, wherein said mounting portion is connected to said frame, said mounting portion having at least one mounting face for fitting against a said structural support, wherein said face is planarly offset from said end portions so that when said frame is mounted to said structural support, there is a space between that portion of said structural support opposing the end portion corresponding therewith, in order to allow a bag's wall to be draped over said support surface and hang over said border; and, b. means for fastening said frame to a structural support, wherein said fastening means enables the fastening of said frame to a structural support so that said mounting face portion lies firmly thereagainst.

13. A bag holder device as claimed in claim 12, wherein each housing is pivotally attached to a portion of said frame respective to each housing's respective end portion so that said respective housing can be rotated onto and off of said housing's respective end portion.

14. A bag holder device as claimed in claim 13, wherein said frame comprises two component members that each have an end portion, wherein said component members connect so that said end portions are oppositely disposed from each other, and wherein means for connecting joins said component members so that at least one of said component members can be moved relative to said other component member, said means for connecting comprising:

a. a channel portion extending along a portion of at least one of said component members with which said other component member slidably connects so that at least one of said component members can be moved relative to said other component member; and, b. means for securing at least one of said component member to said other component member in order to secure said component members at a particular position relative to each other.

15. A bag holder device as claimed in claim 14, wherein said housing has an interior delimited by an inner surface and a mouth portion connecting with said interior, wherein said mouth portion is large enough to receive said respective end portion's support surface therethrough and wherein said interior is at least reciprocally dimensioned to said respective end portion, so that said housing's inner surface can fit tightly over said housing's respective end portion in order to clamp a portion of a bag's wall draped over said end portion tightly thereon.

16. A bag holder device as claimed in claim 15, wherein each housing has a roof portion, said roof portion having an inner surface portion that clamps against at least a portion of a support surface respective to said housing when said housing is fitted over said support surface.

17. A bag holder device as claimed in claim 16, wherein at least a portion of said border of each end portion is convexly curved downward from said support surface.

18. A bag holder device as claimed in claim 16, wherein said fastening means comprises a plurality of spaced holes passing through said frame, and screws insertable therethrough for screwing said frame to a structural support.

19. A bag holder device that comprises:

a. a beam member having a support surface disposed at either end of said beam member upon which a portion of a bag may be draped thereover;

b. clamping means respective to each support surface that comprises a housing adapted to fit releasably and tightly about the periphery of said support surface in order to clamp a portion of a bag's wall draped thereover.

20. A bag holder device as claimed in claim 19, wherein said bag holder device further comprises:

a. two component members comprising said beam member, wherein each component member has a support surface and is connectable so that said support surfaces are disposed at either end of the composite beam member;

b. means for connecting said component members so that at least one of said component members can be moved relative to said other component member; and, c. means for planarly offsetting each support surface from a support structure when said beam member is mounted thereto.

* * * * *